US008985603B2

(12) United States Patent
Fissell

(10) Patent No.: US 8,985,603 B2
(45) Date of Patent: Mar. 24, 2015

(54) SELF-ILLUMINATING SKATEBOARD

(71) Applicant: Sunset Skateboard Company, Newport Beach, CA (US)

(72) Inventor: Jeremy Fissell, San Luis Obispo, CA (US)

(73) Assignee: Sunset Skateboard Company, Newport Beach, CA (US)

( * ) Notice: Subject to any disclaimer, the term of this patent is extended or adjusted under 35 U.S.C. 154(b) by 0 days.

(21) Appl. No.: 13/924,412

(22) Filed: Jun. 21, 2013

(65) Prior Publication Data

US 2014/0375007 A1 Dec. 25, 2014

(51) Int. Cl.
*A63C 17/26* (2006.01)
*A63C 17/01* (2006.01)

(52) U.S. Cl.
CPC ..... *A63C 17/26* (2013.01); *A63C 17/01* (2013.01)
USPC ..... 280/87.042; 280/11.203

(58) Field of Classification Search
CPC .... A63C 17/01; A63C 17/26; A63C 2203/14; B62J 6/12
USPC ..... 280/87.047, 11.203, 87.042
See application file for complete search history.

(56) References Cited

U.S. PATENT DOCUMENTS

| | | | | |
|---|---|---|---|---|
| 4,298,910 | A | 11/1981 | Price | |
| 5,119,277 | A | 6/1992 | Copley et al. | |
| 5,580,093 | A | 12/1996 | Conway | |
| 5,810,450 | A | 9/1998 | Tsu et al. | |
| 5,957,541 | A * | 9/1999 | Seigler | 301/5.301 |
| 6,398,395 | B1 | 6/2002 | Hyun | |
| 6,621,419 | B2 * | 9/2003 | Chiu | 340/815.42 |
| 6,802,636 | B1 * | 10/2004 | Bailey, Jr. | 362/555 |
| 6,818,153 | B2 * | 11/2004 | Burnell-Jones | 252/301.36 |
| 7,048,284 | B1 * | 5/2006 | Seifert | 280/79.11 |
| 7,445,218 | B2 * | 11/2008 | Esposito et al. | 280/87.042 |
| 7,708,289 | B2 * | 5/2010 | Jaime, Sr. | 280/11.203 |
| 8,052,293 | B2 * | 11/2011 | Hurwitz | 362/84 |
| 8,360,239 | B2 | 1/2013 | Kroell | |
| 8,469,569 | B1 * | 6/2013 | Tunnicliffe et al. | 362/545 |
| 8,777,442 | B2 * | 7/2014 | Khan | 362/183 |
| 2002/0018345 | A1 * | 2/2002 | Seifert et al. | 362/459 |
| 2007/0206375 | A1 * | 9/2007 | Piepgras et al. | 362/147 |
| 2008/0020166 | A1 * | 1/2008 | Esposito et al. | 428/41.7 |
| 2008/0265539 | A1 | 10/2008 | Gregorio | |
| 2012/0275142 | A1 * | 11/2012 | Lundy | 362/184 |
| 2012/0326403 | A1 | 12/2012 | Lin | |
| 2013/0026723 | A1 | 1/2013 | Genov et al. | |
| 2013/0228990 | A1 * | 9/2013 | Baldauf et al. | 280/87.042 |

* cited by examiner

*Primary Examiner* — John Walters
*Assistant Examiner* — Brian Swenson
(74) *Attorney, Agent, or Firm* — Morgan, Lewis & Bockius LLP; Brett A. Lovejoy

(57) ABSTRACT

Provided is a skateboard having a transparent or translucent deck, elongated along a longitudinal axis, and having top and bottom surfaces. First and second wheel assemblies are respectively attached to the bottom front and bottom rear portions of the board. Each wheel assembly comprises a truck and two wheels. Each wheel is associated with an axle and has (i) a rotational axis aligned with the wheel axle, (ii) a transparent or translucent wheel covering having a surface conforming to a mathematical surface defined by revolving a continuous, smooth curve about the axis, and (iii) a wheel interior defined by the rotational axis and the wheel covering. This interior houses a generator electrically coupled to light emitting devices. The light emitting devices emit light when the generators generate electricity, thereby illuminating a graphic on the deck in a manner visible from the top surface of the deck through the deck.

23 Claims, 9 Drawing Sheets

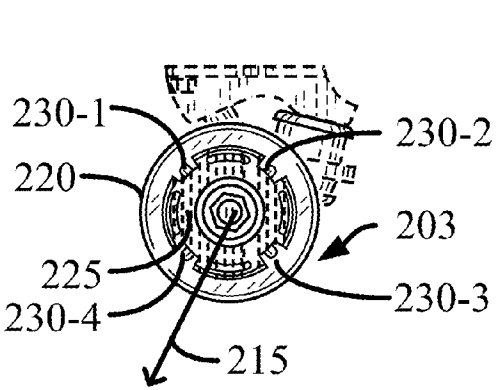
FIG. 9
FIG. 10
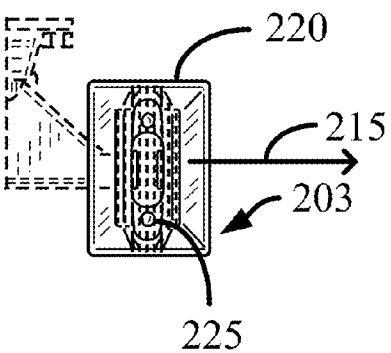
FIG. 11

SELF-ILLUMINATING SKATEBOARD

TECHNICAL FIELD

The disclosed embodiments relate generally to a self-illuminating skateboard.

BACKGROUND

In recent years, skateboarding has increased in popularity as a recreational activity. Skateboards have found other uses as well. For instance, some messengers and couriers use skateboards as a mode of transportation. Frequently these skateboards are used in the evenings or at night when, due to poor visibility there is greater likelihood of accidents and injuries resulting from their use. In order to make the device, and hence the person riding thereon, safely visible, it has been proposed to use an illuminating device in conjunction with the skateboard. Thus, U.S. Pat. No. 4,336,573 discloses an illuminated skateboard comprising a person carrying platform under which is a pair of axles supported from the platform and rolling wheels engaged thereon. A power source is disposed on the bottom surface of the platform and is operatively connected to a light source so as to illuminate the wheels of the skateboard. The wheels are made from translucent material in order to transmit the light generated by the power source along the outer faces of the wheels.

Such illumination of skateboards has only increased their popularity. However, to date, illuminated skateboard have come in two types: those in which the illumination source is in the wheels and those in which the illumination source it built into the board. In order to provide further safety, as well as to differentiate over simple older methods of illumination, what is needed in the art are new ways to illuminate skateboards such that light is distributed in new and attention garnering ways. Such skateboards will not only be safer, they will provide the ability to distinguish over older skateboard designs.

SUMMARY

The disclosed skateboards address the drawbacks found in the prior art. Provided are skateboards having a transparent or translucent deck that is elongated along a longitudinal axis. The deck has a top and a bottom surface. One wheel assembly is attached to the bottom front portion of the board and another is attached to a bottom rear portion of the board. Each of these wheel assemblies has a truck and two wheels. Each wheel is associated with an axle. Moreover, each wheel has (i) a rotational axis aligned with the wheel axle, (ii) a transparent or translucent wheel covering having a surface conforming to a mathematical surface defined by revolving a continuous, smooth curve about the axis, and (iii) a wheel interior defined by the rotational axis and the wheel covering. The wheel interior houses a generator electrically coupled to light emitting devices. The light emitting devices emit light when the generators generate electricity, thereby illuminating a graphic on the deck in a manner visible from the top surface of the deck through the deck. In this way the skateboard distributes light in new and attention garnering ways. Advantageously, such skateboards are not only safer, they also distinguish over older skateboard designs.

In further detail, one aspect of the present disclosure provides a skateboard comprising a transparent or translucent plastic deck, elongated along a longitudinal axis. The deck has a front portion and a rear portion with respect to the longitudinal axis. The deck further has a top surface and a bottom surface. A first wheel assembly is attached to the front portion of the board on the bottom surface. A second wheel assembly is attached to the rear portion of the board on the bottom surface. The first and second wheel assemblies each comprise a truck and two wheels. Each respective wheel is associated with an axle. Moreover, each respective wheel comprises (i) a rotational axis aligned with the associated axle of the respective wheel, (ii) a transparent or translucent wheel covering having a surface substantially conforming to a mathematical surface defined by revolving a continuous, smooth curve about the rotational axis, and (iii) a wheel interior defined by the rotational axis and the transparent or translucent wheel covering. The wheel interior, in turn, houses (i) a wheel generator that and (ii) a plurality of light emitting devices electrically coupled to the wheel generator. The plurality of light emitting devices emits light when the corresponding wheel generator generates electricity. In some embodiment the wheel generator generates electricity according to the rotation of the corresponding wheel about the rotational axis. There is a graphic on the top surface or the bottom surface of the transparent or translucent plastic deck. This graphic is illuminated, in a manner visible from the top surface of the deck through the transparent or translucent plastic deck, by each respective plurality of light emitting devices when the corresponding wheel generators generate electricity.

In some embodiments, each respective plurality of light emitting devices is a plurality of light emitting diodes that, when powered by electricity from the corresponding wheel generator, emit a light having a green, blue, white, red, pink, purple, yellow or orange light.

In some embodiments, each respective plurality of light emitting devices is four light emitting diodes evenly spaced around a corresponding rotational axis.

In one embodiment, when powered by electricity from a corresponding wheel generator, a respective plurality of light emitting devices collectively emit a purple light. Moreover, in such embodiments, the respective plurality of light emitting devices comprises a first and second pink light emitting diode and a first and second blue light emitting diode. These different diodes are alternatively spaced about the rotational axis to give rise to the appearance of the purple light.

In some embodiments, the graphic is on the bottom surface of the transparent or translucent plastic deck and the graphic includes a first portion that is opaque and a second portion that is transparent or translucent.

In some embodiments, the graphic is on the bottom surface of the transparent or translucent plastic deck and the graphic includes an inverted message that is legible when viewed through the top surface.

In some embodiments, each respective plurality of light emitting devices comprises a plurality of light emitting diodes. In such embodiments, when powered by a corresponding wheel generator, each respective plurality of light emitting devices emits an ultraviolet light. Moreover, the plastic deck is embedded with an infused glow powder that emits a visible light responsive to the ultraviolet light.

In some embodiments, each respective plurality of light emitting devices comprises a plurality of light emitting diodes such that, when powered by a corresponding wheel generator, each respective plurality of light emitting devices emits an ultraviolet light. Moreover, the transparent or translucent wheel covering is embedded with an infused glow powder that emits a visible light responsive to the ultraviolet light.

In some embodiments, the graphic comprises a repeating pattern, a message, a logo. In some embodiments, the graphic comprises a corporate logo or a trademark.

In some embodiments, the graphic is on the bottom surface of the board and is inverted.

In some embodiments, the graphic is a CMYK graphic.

In some embodiments, an intensity of a light emitted by the plurality of light emitting devices is determined by an amount of electricity generated by a corresponding wheel generator. Moreover, an amount of electricity generated by the corresponding wheel generator is determined by a speed with which the corresponding wheel rotates about the corresponding rotational axis. For instance, in some embodiments, as the wheel generates faster, the corresponding wheel generator generates more electricity, and the intensity of a light emitted by the plurality of light emitting devices increases.

In some embodiments, the transparent or translucent wheel covering comprises an opaque patterning. For example, in some embodiments, this opaque patterning is a series of stripes across the wheel so that the wheel appears to flash as it rotates.

In some embodiments, the graphic occupies the entire bottom surface and includes an opaque border region and a transparent or translucent interior region. In some embodiments, this transparent or translucent interior region comprises a picture, a message, a word, a trademark, or a logo.

In some embodiments, wherein the graphic occupies the entire bottom surface and includes a transparent or translucent border region and an opaque interior region.

In some embodiments, the wheel generator is battery powered and is controlled between at least an electricity producing state and an off state by a manually operated switch electrically coupled to the wheel generator and the corresponding plurality of light emitting devices.

In some embodiments, a first portion of the graphic has a first degree of transparency and a second portion of the graphic has a second degree of transparency and wherein the first degree of transparency is different than the second degree of transparency.

BRIEF DESCRIPTION OF THE DRAWINGS

FIG. 9 is a perspective view of a wheel of the skateboard of FIG. 1;

FIG. 10 is a first side view of the wheel of the skateboard of FIG. 1;

FIG. 11 is a second side view of the wheel of the skateboard of FIG. 1.

Like reference numerals refer to corresponding parts throughout the drawings.

DESCRIPTION OF EMBODIMENTS

Figure 1:
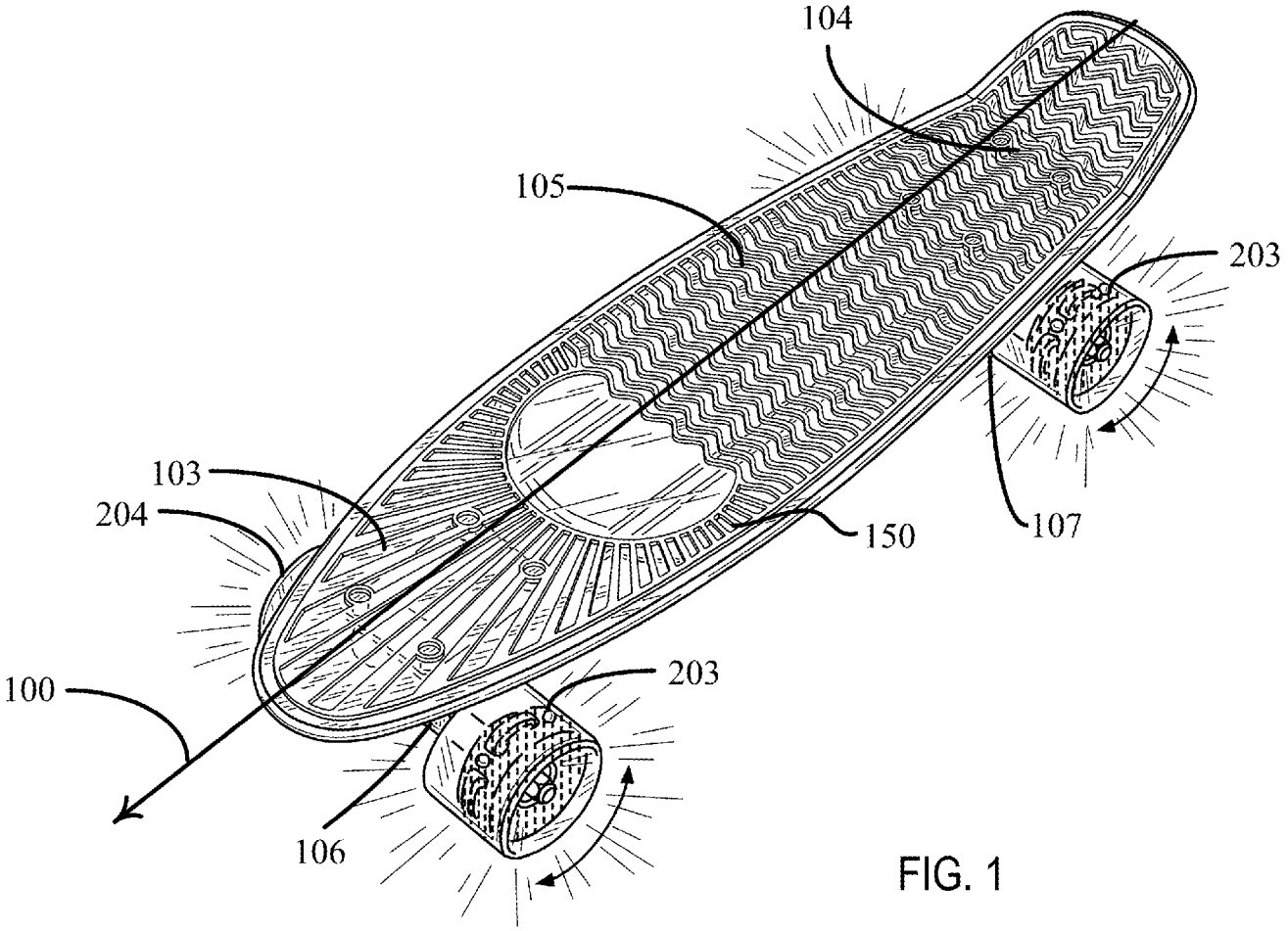
FIG. 1 is a perspective view of an embodiment of skateboard in accordance with an embodiment of the present disclosure.

It will also be understood that, although the terms "first," "second," etc. may be used herein to describe various elements, these elements should not be limited by these terms. These terms are only used to distinguish one element from another. For example, a first wheel could be termed a second wheel, and, similarly, a second wheel could be termed a first wheel, without changing the meaning of the description, so long as all occurrences of the "first wheel" are renamed consistently and all occurrences of the second wheel are renamed consistently. The first wheel and the second wheel are both wheels, but they are not the same wheel.

The terminology used herein is for the purpose of describing particular embodiments only and is not intended to be limiting of the claims. As used in the description of the embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined (that a stated condition precedent is true)" or "if (a stated condition precedent is true)" or "when (a stated condition precedent is true)" may be construed to mean "upon determining" or "in response to determining" or "in accordance with a determination" or "upon detecting" or "in response to detecting" that the stated condition precedent is true, depending on the context.

The term "deck" as used herein means the platform of a skateboard. There are many kinds of decks, and they may be composed of many different materials. They are rigid so that they may hold the weight of the rider, and are also preferably somewhat flexible to absorb shock for a smoother ride.

The term "truck" as used herein means an assembly attached to the deck that holds the wheels of the skateboard. It typically comprises a base and a hanger. Typically, the base is fixedly attached to the deck, and the hanger is a movable portion to which the wheels are attached via axles.

Reference will now be made in detail to various embodiments, examples of which are illustrated in the accompanying drawings. In the following detailed description, numerous specific details are set forth in order to provide a thorough understanding of the invention and the described embodiments. However, the invention may be practiced without these specific details. In other instances, well-known methods, procedures, components, and circuits have not been described in detail so as not to unnecessarily obscure aspects of the embodiments.

Figure 5:
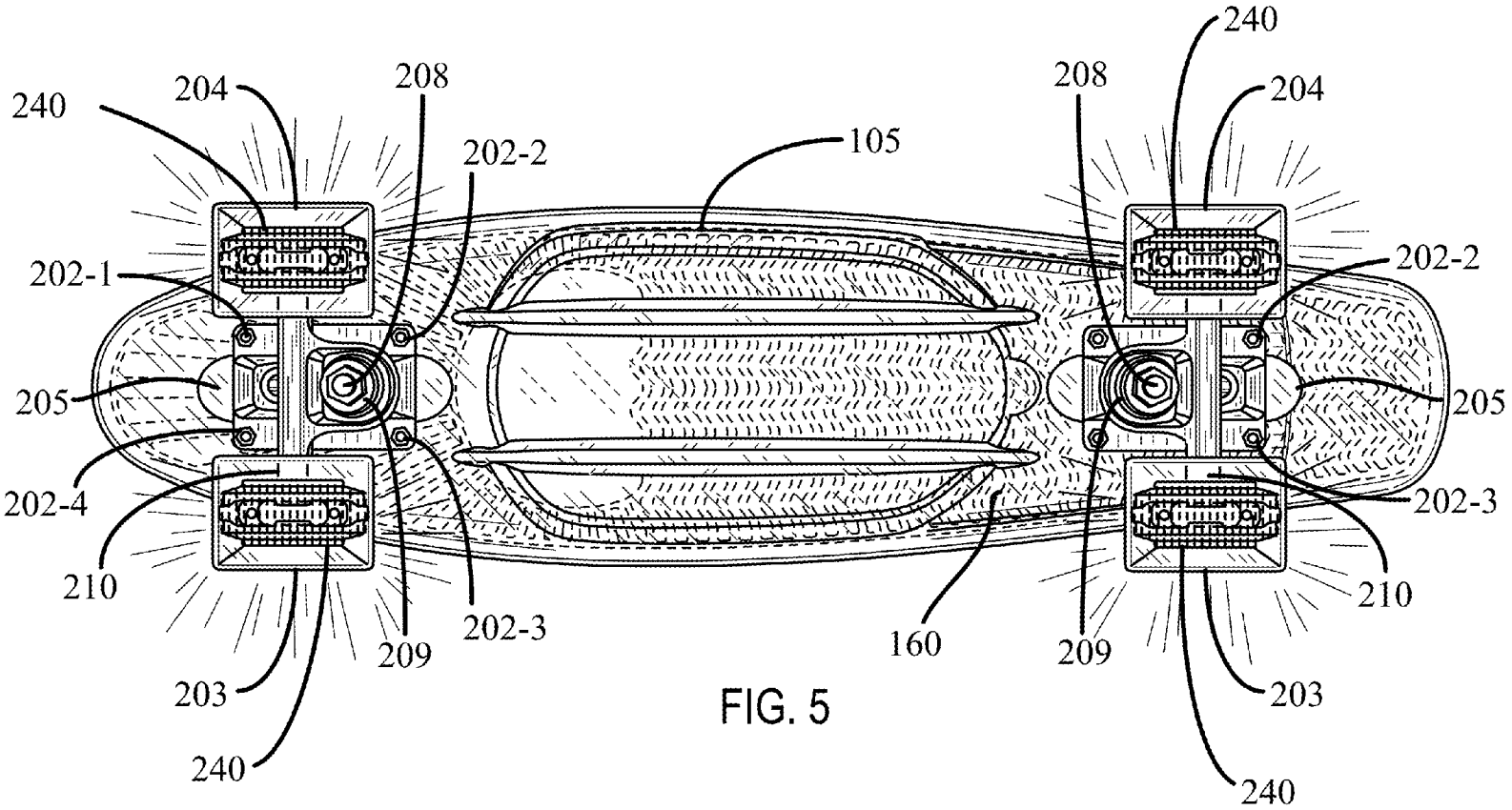
FIG. 5 is a bottom view of the skateboard of FIG. 1, in which the dashed lines are showing topological features of the top side of the transparent board.
Figure 7:
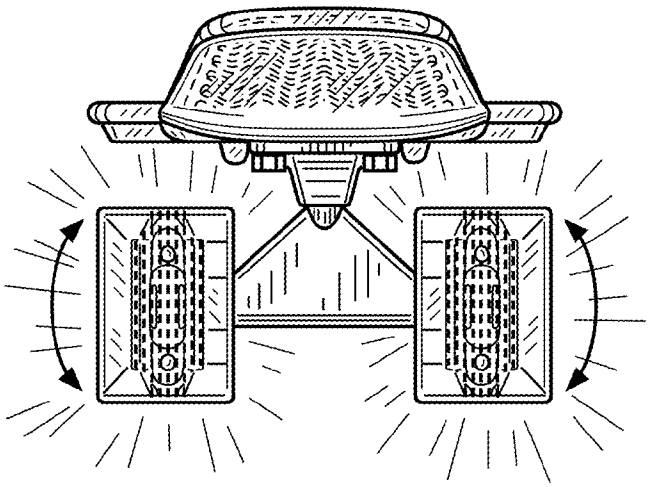
FIG. 7 is a back view of the skateboard of FIG. 1, in which the dashed lines are showing topological features of the top side of the transparent board.
Figure 6:
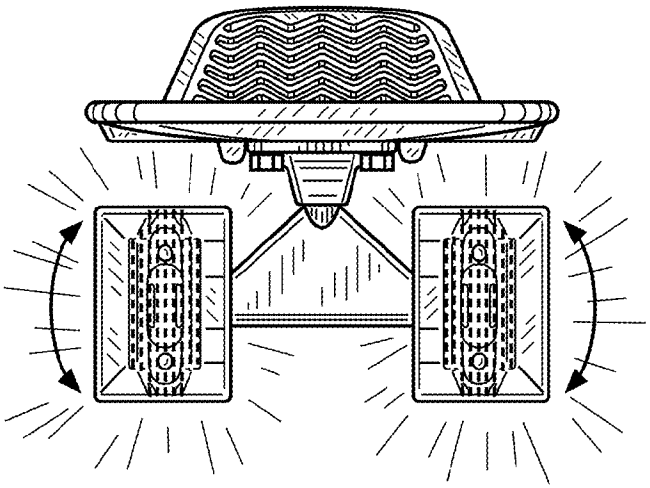
FIG. 6 is a front view of the skateboard of FIG. 1.

FIG. 1 shows a skateboard in accordance with the present disclosure from a perspective view. This skateboard comprises a deck 105 and wheel assemblies 106 and 107. The skateboard is elongated along a longitudinal axis 100, having front 103 and rear 104 portions with respect to the longitudinal axis. The deck has a top surface 150 and a bottom surface 160 (FIG. 5). Other skateboard configurations are possible, including boards with three or more wheel assemblies, or a single wheel assembly, which may make use of the wheel assemblies and wheels disclosed herein.

Advantageously, deck 104 is transparent or translucent and is made of plastic. In this way, wheels 203/204 and the lower surface 160 are visible from the top surface of the deck through the transparent or translucent plastic deck.

FIG. 5 is a bottom view of the skateboard of FIG. 1 and shows the wheel assemblies 106 and 107 in greater detail. Each assembly includes a base 201, which is attached to the deck 105 through bolts 202. Each wheel assembly 106/107 has two wheels 203 and 204, a bumper yoke 205, a kingpin 208 that is attached to base 201 via a retaining ring 209, and an axle 210. Alternative arrangements of the above components may be suggested to one of skill in the art.

Referring to FIGS. 2, 9, 10, and 11, wheels 203/204 each include (i) a rotational axis 215 aligned with the associated axle 210 (not shown in FIG. 2 or 9-11, see FIG. 5) of the respective wheel, (ii) a transparent or translucent wheel covering 220 having a surface substantially conforming to a mathematical surface defined by revolving a continuous, smooth curve about the rotational axis, and (iii) a wheel interior 225 defined by the rotational axis 215 and the transparent or translucent wheel covering 220. The wheel interior 225 houses (i) a wheel generator (not shown) configured to generate electricity and (ii) a plurality of light emitting devices 230 electrically coupled to the wheel generator. Advantageously, the plurality of light emitting devices 230 emits light when the corresponding wheel generators generate electricity.

Figure 2:
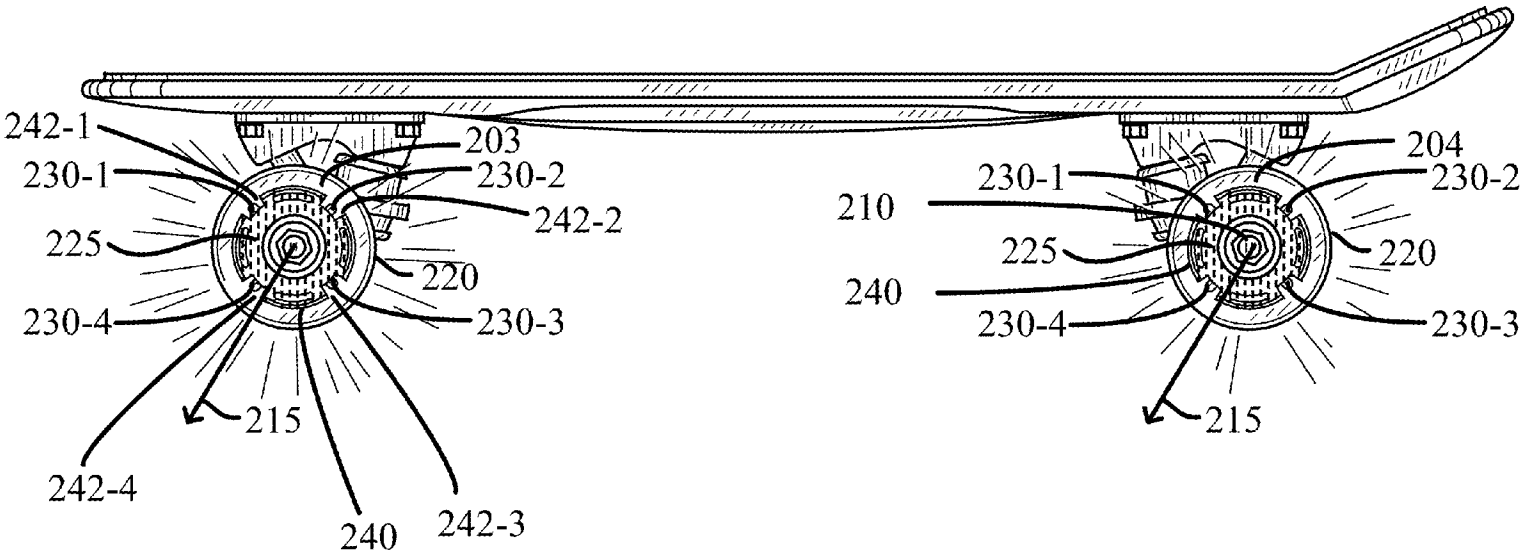
FIG. 2 is a first side view of the skateboard of FIG. 1.
Figure 3:
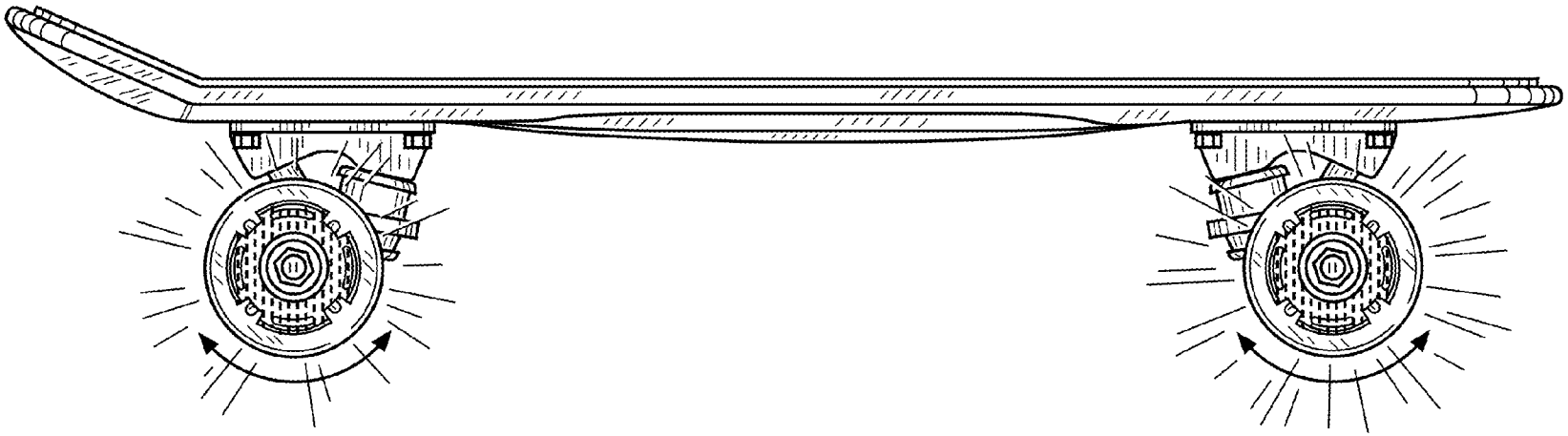
FIG. 3 is a second side view of the skateboard of FIG. 1.
Figure 4:
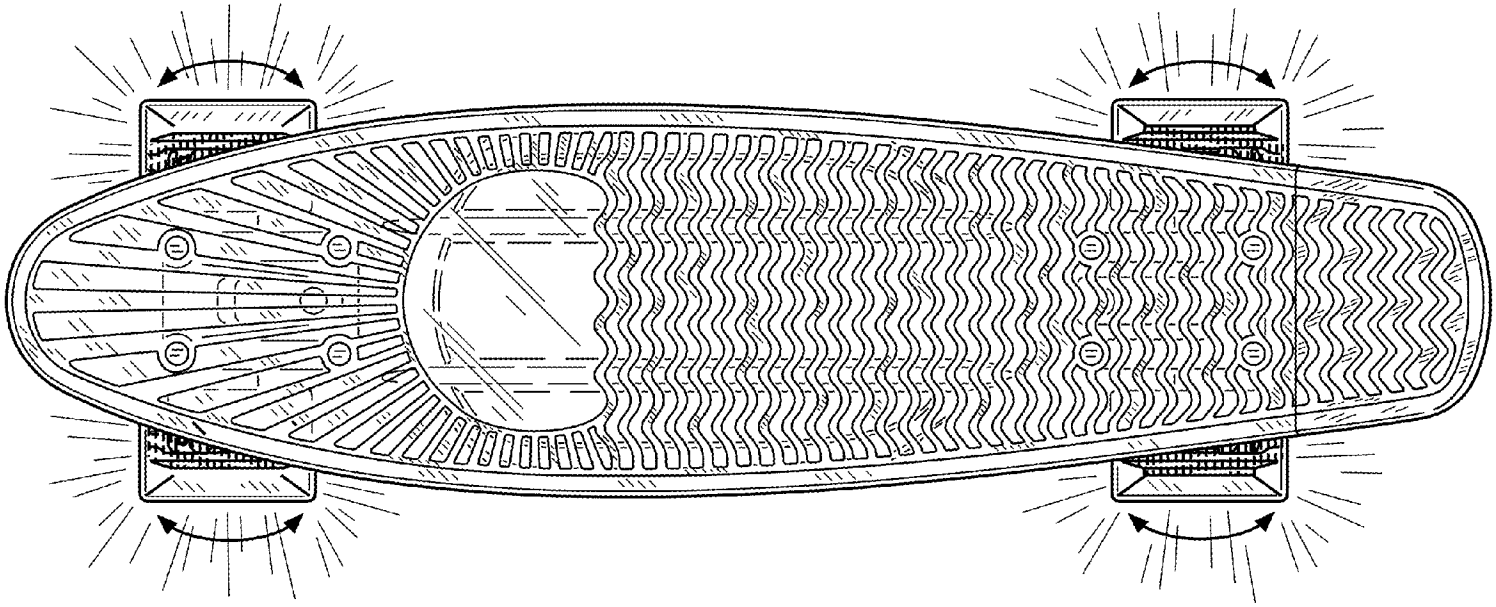
FIG. 4 is a top view of the skateboard of FIG. 1.

As illustrated in FIGS. 2 and 5, and in some embodiments, the plurality of light emitting devices 230 is mounted on an installation bored 240 that is housed in the wheel interior 225 of a wheel 203/204. In some embodiments, the installation board 240 is coupled to the associated axle 210 and rotates about the rotational axis 215. In some embodiments, the installation board 240 comprises a plurality of open-faced notches 242 formed along a circumference of the installation board 240. In some embodiments, at least one light emitting device in the plurality of light emitting devices is received in a notch in the plurality of notches and aligned in a radial direction of the wheel 203/204 such that the at least one light emitting device faces the transparent or Translucent wheel covering 220 in the radial direction of the wheel 203/204. In Some embodiments, the plurality of open-faced notches 242 includes four open-faced notches, e.g., 242-1, 242-2, 242-3 and 242-4, evenly spaced around a corresponding rotational axis 215.

Figure 12:
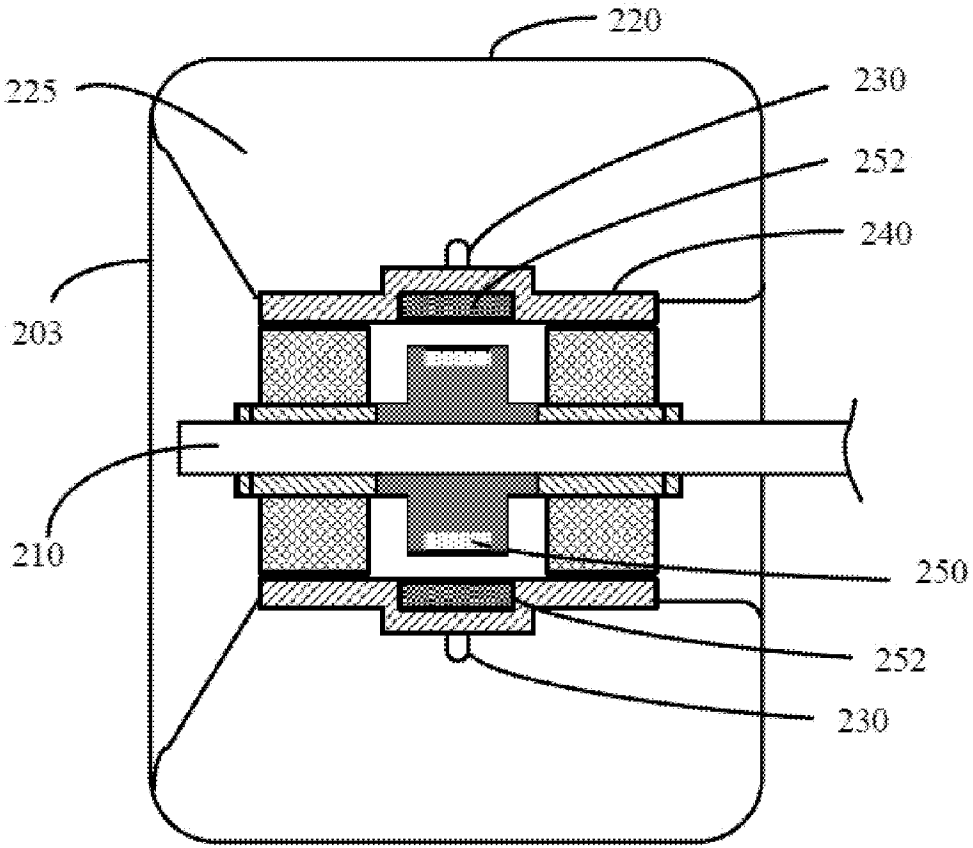
FIG. 12 is a cross-sectional view illustrating a generator.

An example of wheel generators that can be used in the wheels 203/204 include those described in U.S. Pat. Nos. 4,298,910; 4,648,410; 5,580,093; 5,810,450; and 6,398,395, each of which is hereby incorporated by reference herein in its entirety. In general, such wheel generators make use of electromagnetic induction from the rotation of the wheels about their respective rotational axes. For example, FIG. 12 illustrates a generator such as those described in U.S. Pat. Nos. 4,298,910; 4,648,410; 5,580,093; 5,810,450; and 6,398,395, including a magnet 250 coupled to or mounted on the axle 210 and an induction coil or coils 252 coupled to or mounted on an installation board 240 to generate electricity. Advantageously, in some disclosed embodiments herein, the plurality of light emitting devices 230 is a plurality of light emitting diodes that, when powered by electricity from the corresponding wheel generator, emit a light having a color selected from the group consisting of green, blue, white, red, pink, purple, yellow and orange.

In some embodiments, the plurality of light emitting devices 230 is four light emitting diodes evenly spaced around a corresponding rotational axis. In some embodiments, the plurality of light emitting devices 230 is two, three, four, five, six, seven, eight, nine, or ten light emitting diodes evenly spaced around a corresponding rotational axis. In some embodiments, there are one, two or three or more light emitting diodes at each of two, three, four, or five or more positions about the rotational axis of the wheel. As shown in FIG. 9, there are four light emitting diodes at each of four evenly spaced positions about the rotational axis of the wheel.

In some embodiments, in order to get emission of a sufficiently bright purple light, the plurality of light emitting devices 230 collectively emit the purple light through the contribution of first and second pink light emitting diodes and first and second blue light emitting diodes, where the pink and blue diodes are alternatively but evenly spaced about the rotational axis of the wheel.

In some embodiments, the wheel covering 220 may be tapered, so that the slope of the function representing the diameter as a profile versus the distance from the inside edge of the wheel may have a decreasing slope over at least part of its profile, particularly as the wheel tapers toward its outside edge. Such wheels are disclosed in United States Patent Publication No. 2013/0026723, which is hereby incorporated by reference herein in its entirety. From the point of its maximum to the outside edge, this function is preferably monotonically decreasing. It may preferably be monotonically decreasing for essentially the entire length of the wheel, except perhaps for the inside of the wheel, which may in one embodiment be slightly rounded or beveled, which makes little difference to the overall performance of the wheel.

The continuous, smooth curve of wheel covering 220 may take a variety of shapes. Preferably, it may be an arc of a circle. The diameter at the edge of the wheel may be substantially smaller than the maximum diameter. The wheel is preferably elongated so that the dimensions of its width are about the same as its diameter, or it is wider than its diameter.

In some embodiments, the wheel covering 220 is described by reference to an ideal mathematical surface to which the wheel substantially conforms. Due to machining, molding, or other manufacturing variations, or because of the inherent roughness of the surface, or because of wear-and-tear, the wheel like any other physical object is not precisely a mathematical object, and may vary on the order of several millimeters from any ideally-defined shape. Similarly, two ideal shapes may be substantially, but not identically, the same, and still provide essentially the same performance, stability, and maneuverability to the rider, such that the rider does not detect a significant or noticeable difference during usage. Such differences may be on the order of at least several millimeters. Minor changes in dimension or scale, or slightly lengthening scale in one dimension while keeping the scale in another dimension the same or less, may also provide an insubstantial change to the ideal mathematical shape.

Figure 8:
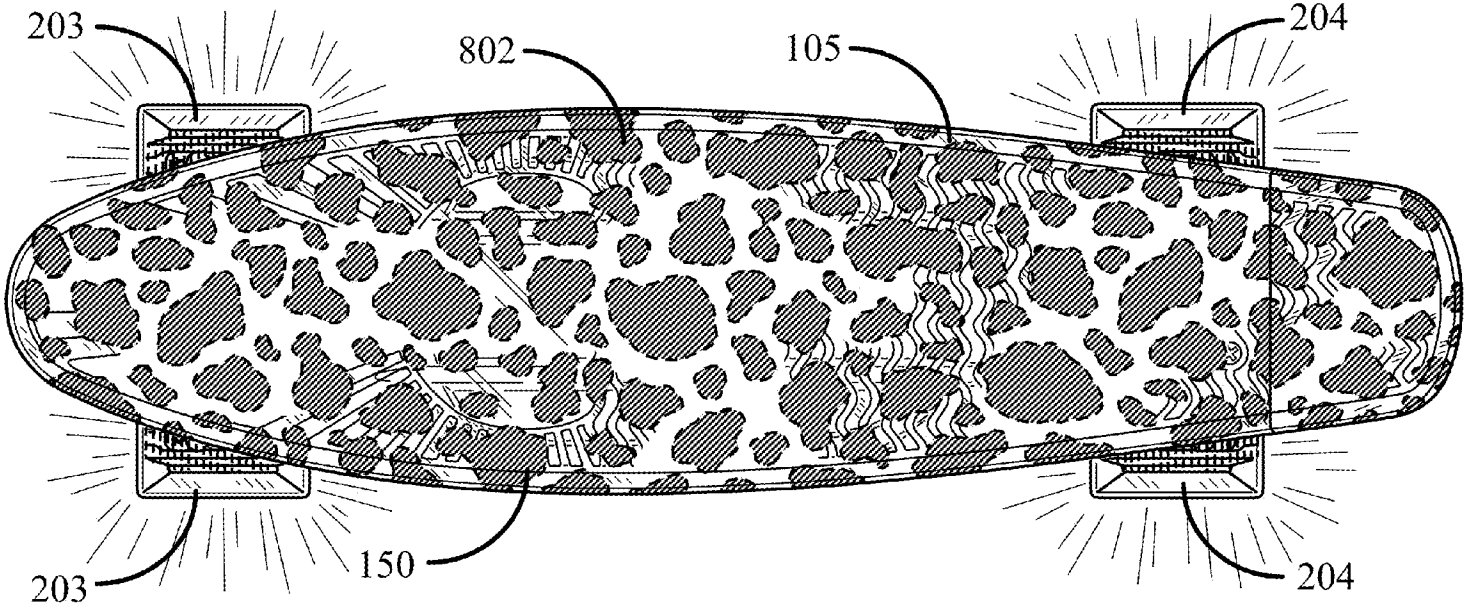
FIG. 8 is another top view of the skateboard of FIG. 1, in which there is graphic on the bottom surface of the transparent or translucent plastic deck of the skateboard, and in which the graphic is illuminated, in a manner visible from the top surface of the deck through the transparent or translucent plastic deck.

Advantageously, the disclosed skateboards include a graphic on the top surface 150 or the bottom surface 160 of the deck 105. Because the skateboard is transparent or translucent, this graphic is illuminated, in a manner visible from the top surface 150 of the deck 105 through the deck, by each respective plurality of light emitting devices 230 when the corresponding wheel generators generate electricity. In typical embodiments, such wheel generators generate electricity when the wheels 203/204 are rotating about their respective rotational axes 215. FIG. 8 illustrates how the light from the wheels 203/204 illuminate a graphic 802 on the bottom surface 160 of deck 105 in a manner visible from the top surface 150 of the deck 105 because the deck is transparent or translucent. In FIG. 802, the graphic 802 has a classic cow print texture. In some embodiments, the graphic comprises a repeating pattern such as depictions of small animals or other forms of classic prints. In some embodiments, the graphic comprises a message or a logo. For example, the graphic could be a company logo. 10. The skateboard of claim 1, wherein the graphic comprises a message or a logo. In some embodiments, the graphic comprises a corporate logo or a trademark. In some embodiments, the graphic is on the bottom surface 160 and is inverted.

In some embodiments, the graphic is on the bottom surface 160 of the deck 105 and the graphic includes a first portion that is opaque and a second portion that is transparent or translucent. Referring to FIG. 8 for illustration, in some embodiments the dark portions of the cow print graphic 802 are opaque whereas the light portions are transparent or translucent. The presence of opaque portions of the graphic 802 do not permit light through the top surface 150 and thus the transparent or translucent portions that do permit light through the top surface 150 are enhanced by the dart contrast of the opaque portions of the graphic. Although a cow print graphic 802 of FIG. 8 is used to illustrate this feature, it will be appreciated that the transparent or translucent portions of the graphic in such embodiments could spell out a word or phrase while the opaque portions of the graphic serves as the background to this word or phrase. In fact, in some embodiments, the graphic is on the bottom surface 160 of the deck 105 and the graphic includes an inverted message that is legible when viewed through the top surface 150 of the deck 105.

In some embodiments, the graphic occupies the entire bottom surface 160 and includes an opaque border region and a transparent or translucent interior region. In some such embodiments the transparent or translucent interior region comprises a picture, a message, a word, a trademark, or a logo.

In some embodiments, the graphic occupies only a portion of the bottom surface 160, such as a center portion of the bottom surface, and includes an opaque border region and a transparent or translucent interior region. In some such embodiments the transparent or translucent interior region comprises a picture, a message, a word, a trademark, or a logo.

In some embodiments, the plurality of light emitting devices 230 comprises a plurality of light emitting diodes that, when powered by a corresponding wheel generator, emits an ultraviolet light. By its nature, ultraviolet light is not visible to the human eye. However, advantageously, in some such embodiments the transparent or translucent deck 105 and/or the wheel covering is 220 embedded with an infused glow powder that emits a visible light responsive to the ultraviolet light. In some such embodiments, the skateboard further includes a graphic on the top surface 150 or the bottom surface 160 of the deck 105.

In embodiments that make use of ultraviolet light, the ultraviolet light can charge a printed ink or paint infused with glow powder (translucent, transparent, or opaque) thereby causing the glow powder to emit visible light, charge a plastic or rubber (like PU) infused with glow powder thereby causing the glow powder t emit visible light, or illuminate a fluorescent color ink, paint, plastic, rubber, etc., thereby causing the fluorescent color ink, paint, plastic, or rubber to emit a visible light.

Regarding fluorescence, this type of luminescence occurs when some form of radiation, such as ultraviolet light, causes an object to glow. For example, fluorescent papers and poster boards glow in the daylight. They may seem to glow even brighter under black light (ultraviolet), but in either case, as soon as the light is removed, the glow stops. Fluorescent objects do not glow in the dark all by themselves, they require some other form of energy such as ultraviolet light to "excite" them. One manufacturer of suitable fluorescent pigments that can be used in the disclosed embodiments is Glow, Inc. Severn, Md.

In some embodiments a phosphorescent compound is used. Phosphorescence is just like fluorescence, except that the glow continues even after the light used to excite it is removed. "Glow in the dark" toys phosphoresce brightly in total darkness after being "charged" or excited by ordinary white or ultraviolet light. Glow powder works by absorbing surrounding light energy and then releases that energy when the lights go out. Glow powder is typically made with zinc sulfide or other methods like strontium aluminate pigments.

In some embodiments, a first portion of the graphic has a first degree of transparency and a second portion of the graphic has a second degree of transparency, where the first degree of transparency is different than the second degree of transparency. In fact, the graphic can have any number of different portions, each with an independent, and quite possibly unique, degree of transparency. Moreover, the graphic can have any number of different portions, each with an independent, and quite possibly unique, color.

In some embodiments the graphic is a CMYK graphic. In some embodiments the graphic is transferred onto the top surface 150 or, more preferably, the bottom surface using hydrographics, also known as water transfer imaging. In one such process, the deck 105 is pre-treated and a base coat material is applied. A polyvinyl alcohol film is gravure-printed with the graphic image to be transferred, and is then floated on the surface of a vat of water. An activator chemical is sprayed on the film to dissolve it into a liquid and activate a bonding agent. The deck 105 is then lowered into the vat, through the floating ink layer, which wraps around and adheres to it. After removing the deck 105 from the water, a top coat is applied to protect the design. A kit for performing such a transfer is disclosed in U.S. Pat. No. 8,360,239, which is hereby incorporated by reference herein in its entirety.

In some embodiments, the transparent or translucent wheel covering 200 has an opaque patterning, such as stripes in order to create a special effect as the wheels rotate. In some embodiments, rather than an opaque patterning the wheel covering 200 is transparent but has a translucent patterning in order to create a special effect.

In some embodiments, an intensity of a light emitted by the plurality of light emitting devices 230 is determined by an amount of electricity generated by a corresponding wheel generator. In such embodiments, an amount of electricity generated by the corresponding wheel generator is determined by a speed with which the corresponding wheel 203/204 rotates about the corresponding rotational axis. However, in some embodiments, the wheel generator is not operated by electromagnetic induction but rather is battery powered. In such embodiments, the wheel generator is controlled between at least an electricity producing state and an off state by a manually operated switch (not shown) electrically coupled to the wheel generator and the corresponding plurality of light emitting devices 230 of a given wheel. In some embodiments, the switch provides for additional states, such as a bright light setting and a dim light setting. In embodiments having a switch, the switch is mounted on a wheel covering 200 in a region that does not get exposed to pavement or other riding surfaces.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A skateboard comprising:

a transparent or translucent plastic deck, independent of any light sources, elongated along a longitudinal axis, having front and rear portions with respect to the longitudinal axis, the transparent or translucent plastic deck further having a top surface and a bottom surface;

a first wheel assembly attached to the front portion of the deck on the bottom surface;

a second wheel assembly attached to the rear portion of the deck on the bottom surface; wherein the first and second wheel assemblies each comprise a truck and two wheels, each respective wheel associated with an axle, and each respective wheel comprising:

(i) a rotational axis aligned with the associated axle of the respective wheel, (ii) a transparent or translucent wheel covering having a surface defined by revolving a continuous, smooth curve about the rotational axis, and (iii) a wheel interior defined by the rotational axis and the transparent or translucent wheel covering, the wheel interior housing (a) a wheel generator configured to generate electricity, (b) a plurality of light emitting devices electrically coupled to the wheel generator, wherein the plurality of light emitting devices emit light when the corresponding wheel generator generates electricity, and (c) an installation board coupled to the associated axle and comprising a plurality of open-faced notches formed along a circumference of the installation board and facing the transparent or translucent wheel covering in a radial direction of the wheel, wherein at least one light emitting device in the plurality of light emitting devices is received in a notch in the plurality of notches and aligned in the radial direction of the wheel such that the at least one light emitting device faces the transparent or translucent wheel covering in the radial direction of the wheel; and a graphic on the top surface or the bottom surface of the transparent or translucent plastic deck, the graphic being illuminated, in a manner visible from the top surface of the deck through the transparent or translucent plastic deck, by each respective plurality of light emitting devices when the corresponding wheel generators generate electricity.

2. The skateboard of claim 1, wherein each respective plurality of light emitting devices is a plurality of light emitting diodes that, when powered by electricity from the corresponding wheel generator, emit a light having a color selected from the group consisting of green, blue, white, red, pink, purple, yellow and orange.

3. The skateboard of claim 1, wherein each respective plurality of light emitting devices is four light emitting diodes evenly spaced around a corresponding rotational axis.

4. The skateboard of claim 1, wherein, when powered by electricity from a corresponding wheel generator, a respective plurality of light emitting devices collectively emit a purple light, and wherein the respective plurality of light emitting devices comprises a first and second pink light emitting diode and a first and second blue light emitting diode.

5. The skateboard of claim 1, wherein the graphic is on the bottom surface of the transparent or translucent plastic deck and wherein the graphic includes a first portion that is opaque and a second portion that is transparent or translucent.

6. The skateboard of claim 1, wherein the graphic is on the bottom surface of the transparent or translucent plastic deck and wherein the graphic includes an inverted message that is legible when viewed through the top surface.

7. The skateboard of claim 1, wherein each respective plurality of light emitting devices comprises a plurality of light emitting diodes and wherein, when powered by a corresponding wheel generator, each respective plurality of light emitting devices emits an ultraviolet light, and wherein the plastic deck is embedded with an infused glow powder that emits a visible light responsive to the ultraviolet light.

8. The skateboard of claim 1, wherein each respective plurality of light emitting devices comprises a plurality of light emitting diodes and wherein, when powered by a corresponding wheel generator, each respective plurality of light emitting devices emits an ultraviolet light, and wherein the transparent or translucent wheel covering is embedded with an infused glow powder that emits a visible light responsive to the ultraviolet light.

9. The skateboard of claim 1, wherein the graphic comprises a repeating pattern.

10. The skateboard of claim 1, wherein the graphic comprises a message or a logo.

11. The skateboard of claim 1, wherein the graphic comprises a corporate logo or a trademark.

12. The skateboard of claim 1, wherein the graphic is on the bottom surface and is inverted.

13. The skateboard of claim 1, wherein the graphic is a CMYK graphic.

14. The skateboard of claim 1, wherein an intensity of a light emitted by the plurality of light emitting devices is determined by an amount of electricity generated by a corresponding wheel generator and wherein an amount of electricity generated by the corresponding wheel generator is determined by a speed with which the corresponding wheel rotates about the corresponding rotational axis.

15. The skateboard of claim 1, wherein the transparent or translucent wheel covering comprises an opaque patterning.

16. The skateboard of claim 1, wherein a respective wheel generator generates electricity according to the rotation of the corresponding wheel about the corresponding rotational axis.

17. The skateboard of claim 1, wherein the wheel generator is battery powered and is controlled between at least an electricity producing state and an off state by a manually operated switch electrically coupled to the wheel generator and the corresponding plurality of light emitting devices.

18. The skateboard of claim 1, wherein a first portion of the graphic has a first degree of transparency and a second portion of the graphic has a second degree of transparency and wherein the first degree of transparency is different than the second degree of transparency.

19. The skateboard of claim 1, wherein each installation board rotates about a corresponding rotational axis.

20. The skateboard of claim 1, wherein each respective plurality of open-faced notches is four open-faced notches evenly spaced around a corresponding rotational axis.

21. The skateboard of claim 1, wherein the graphic occupies the entire bottom surface and includes an opaque border region and a transparent or translucent interior region.

22. The skateboard of claim 21, wherein the transparent or translucent interior region comprises a picture, a message, a word, a trademark, or a logo.

23. A skateboard comprising:

a transparent or translucent plastic deck, independent of any light sources, elongated along a longitudinal axis, having front and rear portions with respect to the longitudinal axis, the transparent or translucent plastic deck further having a top surface and a bottom surface;

a first wheel assembly attached to the front portion of the deck on the bottom surface;

a second wheel assembly attached to the rear portion of the deck on the bottom surface; wherein the first and second wheel assemblies each comprise a truck and two wheels, each respective wheel associated with an axle, and each respective wheel comprising:

(i) a rotational axis aligned with the associated axle of the respective wheel, (ii) a transparent or translucent wheel covering having a surface defined by revolving a continuous, smooth curve about the rotational axis, and (iii) a wheel interior defined by the rotational axis and the transparent or translucent wheel covering, the wheel interior housing (a) a wheel generator configured to generate electricity, (b) a plurality of light emitting devices electrically coupled to the wheel generator, wherein the plurality of light emitting devices emit light when the corresponding wheel generator generates electricity, and (c) an installation board coupled to the associated axle and comprising a plurality of open-faced notches formed along a circumference of the installation board and facing the transparent or translucent wheel covering in a radial direction of the wheel, wherein at least one light emitting device in the plurality of light emitting devices is received in a notch in the plurality of notches and aligned in the radial direction of the wheel such that the at least one light emitting device faces the transparent or translucent wheel covering in the radial direction of the wheel; and wherein each respective plurality of light emitting devices emits an ultraviolet light, and wherein the transparent or translucent wheel covering or the deck is embedded with an infused glow powder that emits a visible light responsive to the ultraviolet light.

* * * * *